US010183523B2

(12) United States Patent
Kuroki et al.

(10) Patent No.: US 10,183,523 B2
(45) Date of Patent: Jan. 22, 2019

(54) DOCUMENT FILE AND METHOD FOR ADJUSTING THICKNESS OF THE SAME

(71) Applicant: SOEI CO., LTD., Tokyo (JP)

(72) Inventors: Yoshiki Kuroki, Tokyo (JP); Yusuke Tsuchida, Tokyo (JP); Yu Noma, Tokyo (JP); Masatsugu Onuki, Tokyo (JP)

(73) Assignee: SOEI CO., LTD., Chiyoda-ku, Tokyo (JP)

( * ) Notice: Subject to any disclaimer, the term of this patent is extended or adjusted under 35 U.S.C. 154(b) by 0 days.

(21) Appl. No.: 15/584,037

(22) Filed: May 2, 2017

(65) Prior Publication Data

US 2018/0319199 A1 Nov. 8, 2018

(51) Int. Cl.
*B42F 13/40* (2006.01)
*B42F 7/08* (2006.01)
*B42F 7/06* (2006.01)

(52) U.S. Cl.
CPC ..... *B42F 7/08* (2013.01); *B42F 7/065* (2013.01)

(58) Field of Classification Search
CPC ..... B42F 7/08; B42F 7/065
USPC ..... 229/67.1–67.4
See application file for complete search history.

(56) References Cited

U.S. PATENT DOCUMENTS 4,531,764 A * 7/1985 Chang ..... B42F 13/40 281/29
4,997,207 A * 3/1991 Feldman ..... B42F 13/0006 281/18
5,002,416 A * 3/1991 Serzen ..... B42F 13/00 402/73
5,380,111 A * 1/1995 Westrom ..... B42F 13/0026 402/502
5,398,971 A * 3/1995 Ayele ..... B42F 13/0026 281/20
5,590,909 A * 1/1997 Urban ..... B42F 13/0006 281/20
5,634,666 A * 6/1997 Lee ..... B42F 13/0026 281/20
5,947,521 A * 9/1999 Stucki ..... B42D 9/00 281/20
D639,336 S * 6/2011 Houmes ..... D19/32
9,057,476 B2 * 6/2015 Sweere ..... F16M 13/00

FOREIGN PATENT DOCUMENTS

JP 04298399 A * 10/1992
JP H11-059047 3/1999
JP 2013-039813 2/2013

* cited by examiner

*Primary Examiner* — Jes F. Pascua
(74) *Attorney, Agent, or Firm* — Soei Patent & Law Firm

(57) ABSTRACT

A document file includes a front cover, a rear cover, a spine portion, a first storage portion provided on an inner surface of the front cover, a second storage portion provided on an inner surface of the rear cover, a sheet bendably connected to the second side edge portion of the front cover and movable between a closed position and an open position, a third storage portion provided on a surface of the sheet opposite the front cover, and a spacer provided on at least one of the second storage portion and the third storage portion for adjusting a space between the second side edge portion of the front cover and the second side edge portion of the rear cover.

2 Claims, 15 Drawing Sheets

DOCUMENT FILE AND METHOD FOR ADJUSTING THICKNESS OF THE SAME

FIELD

The disclosure relates to a document file for storing documents and a method for adjusting a thickness of the file.

BACKGROUND

Document files for storing documents have been known such as that described in JP 11-59047 A.

Such a document file has a front cover, a rear cover, and a spine portion, and stores documents between the front cover and the rear cover.

SUMMARY

These document files are often laid flat on a desk and piled on top of each other in the same direction. In this case, as the number of the piled document files increases, the thicknesses of the spine portions of the document files become stacked causing the height on the side of the spine portion to be higher than that on the opposite side, thereby creating a tilt. As a result, the document files on the top may slide off of the pile.

An aspect of the invention relates to a document file for storing documents. This document file includes a rectangular front cover that has opposing first and second side edge portions, a rectangular rear cover that has opposing first and second side edge portions, a spine portion that connects the first side edge portion of the front cover to the first side edge portion of the rear cover, a first storage portion that is provided on an inner surface of the front cover for storing documents, a second storage portion that is provided on an inner surface of the rear cover for storing documents, a sheet that is bendably connected to the second side edge portion of the front cover and movable between a closed position covering the inner surface of the front cover and an open position spaced apart from the inner surface of the front cover, a third storage portion that is provided on a surface of the sheet, opposite the front cover when the sheet is in a configuration wherein the sheet covers the inner surface of the front cover, and a spacer that is provided on at least one of the second storage portion and the third storage portion for adjusting a space between the second side edge portion of the front cover and the second side edge portion of the rear cover.

Another aspect of the invention relates to a document file for storing documents. This document file includes a rectangular front cover that has opposing first and second side edge portions, a rectangular rear cover that has opposing first and second side edge portions, a spine portion that connects the first side edge portion of the front cover to the first side edge portion of the rear cover, a first storage portion that is provided on an inner surface of the front cover for storing documents, a second storage portion that is provided on an inner surface of the rear cover for storing documents, and a spacer that is provided on at least one of the first storage portion and the second storage portion for adjusting a space between the second side edge portion of the front cover and the second side edge portion of the rear cover.

The spacer may include a hook and loop fastener that has a hook portion and a loop portion. One of the hook portion and the loop portion may be secured to the document file, and the other of the hook portion and the loop portion may have flexibility.

Additionally, the spacer may include a plurality of projections that is provided spaced apart on the document file, a first attachment portion to be removably fitted to one of the plurality of projections, a second attachment portion to be removably fitted to another one of the plurality of projections, a first plate piece that is bendably connected to the first attachment portion, and a second plate piece that is bendably connected to the second attachment portion. The first plate piece may be bendably connected to the second plate piece.

Additionally, another aspect of the invention relates to a method for adjusting a thickness of a document file for storing documents. The document file includes a rectangular front cover that has opposing first and second side edge portions, a rectangular rear cover that has opposing first and second side edge portions, a spine portion that connects the first side edge portion of the front cover to the first side edge portion of the rear cover, and a spacer that is provided between the second side edge portion of the front cover and the second side edge portion of the rear cover. The method includes a step of measuring a space between the second side edge portion of the front cover and the second side edge portion of the rear cover and a step of adjusting a height of the spacer according to the measured space.

DETAILED DESCRIPTION

A document file and a method for adjusting a thickness of the file according to an embodiment of the present invention will be described below with reference to the drawings.

Figure 1:
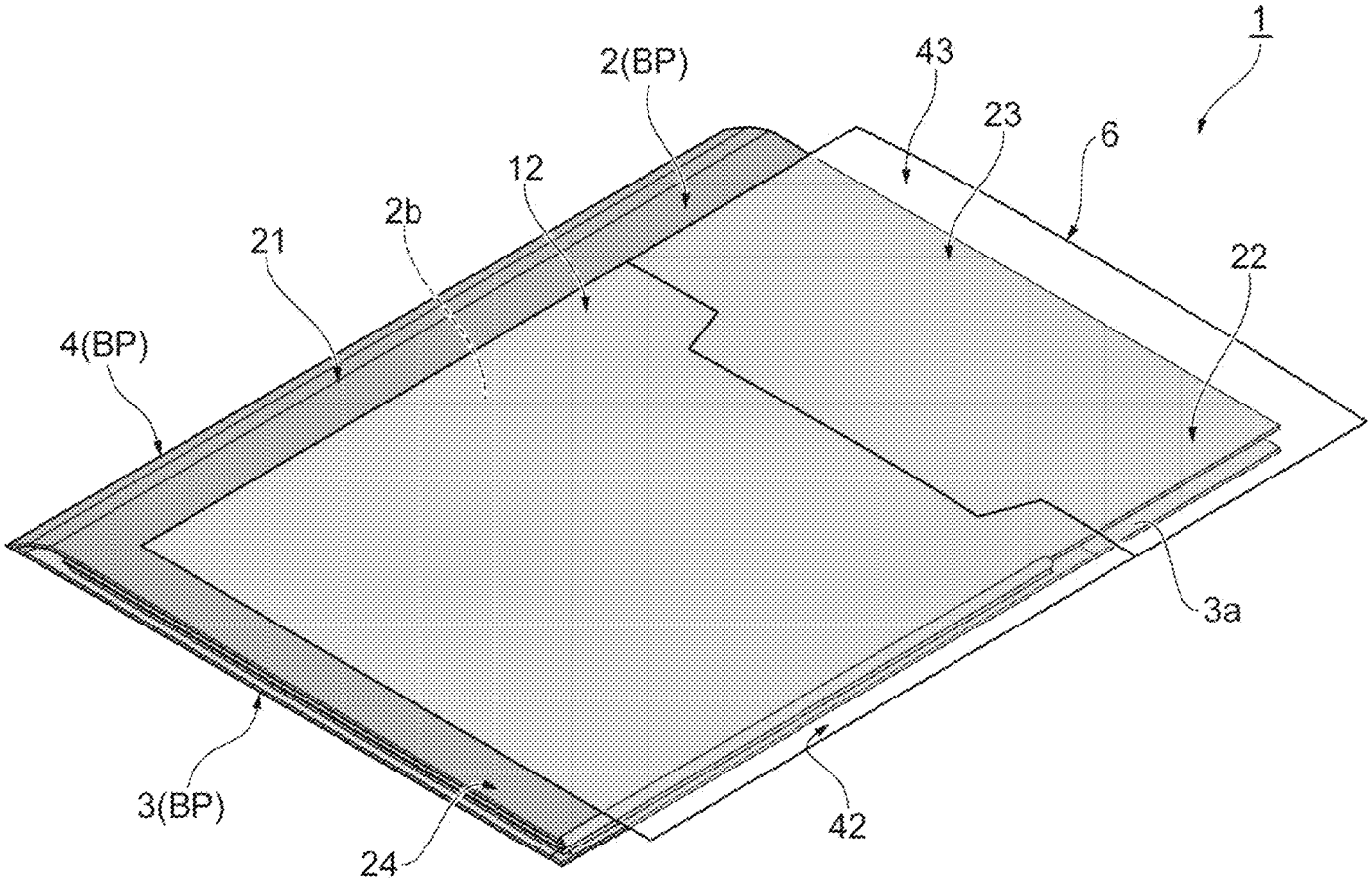
FIG. 1 is a perspective view showing a document file closed.
Figure 2:
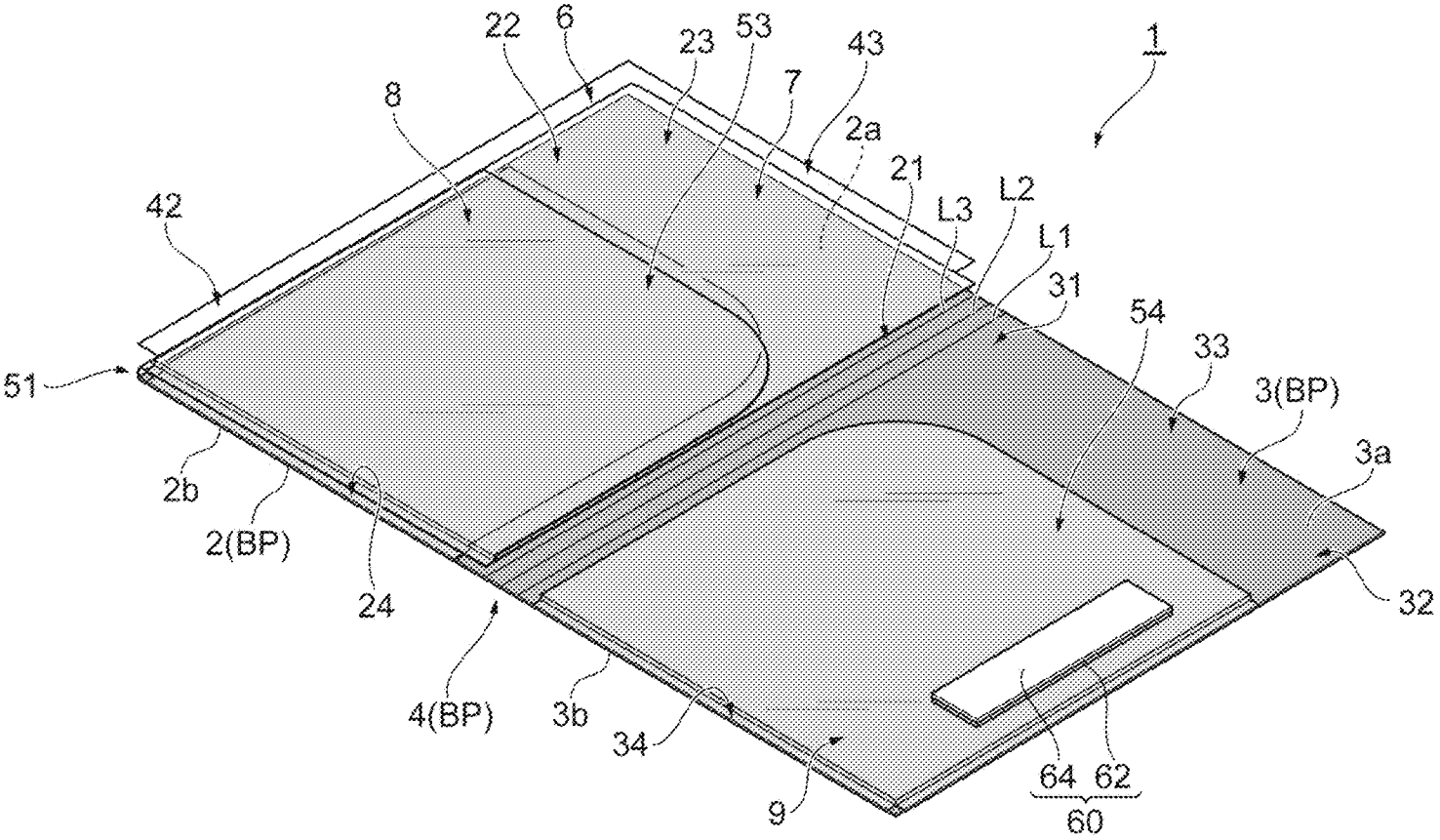
FIG. 2 is a perspective view showing the document file open.
Figure 3:
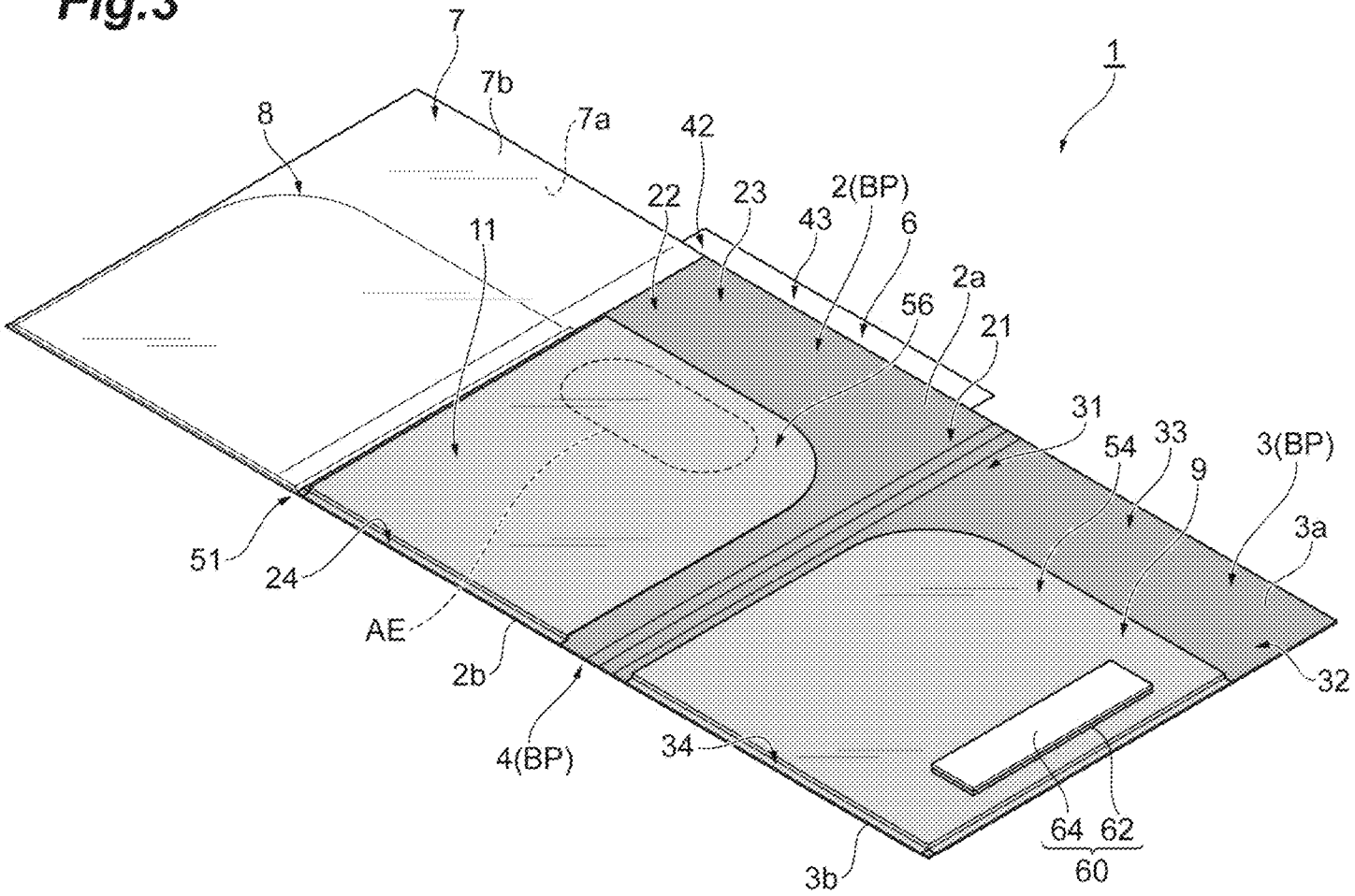
FIG. 3 is a perspective view showing the document file with a sheet open.

As shown in FIGS. 1 to 3, a document file 1 according to the embodiment includes a front cover 2 that constitutes a cover of a front side of the document file 1, a rear cover 3 that constitutes a cover of a rear side thereof, a spine portion 4 that connects the front cover 2 to the rear cover 3, a clear file 6 that is provided on the front cover 2, a sheet 7 that covers a rear surface of the front cover 2, a left side holder (third storage portion) 8 that is located on a left side and a right side holder (second storage portion) 9 that is located on a right side when the document file 1 is opened, an auxiliary holder (first storage portion) 11 that is provided on the rear surface of the front cover 2, and an auxiliary pocket 12 that is provided on the clear file 6. This embodiment describes the document file 1 based on the A4 standard paper size.

The document file 1 is particularly effective when used to assist operations relating to industrial property rights. "Operations relating to industrial property rights" refers to various operations such as filing and prosecuting patent, utility model, design, and trademark applications, trials, litigations, searches, and expert opinions. The document file 1 is also particularly effective when used for operations which involve digitization of file wrapper information of applications.

The document file 1 is capable of storing documents which are classified into five categories at most in five different storage portions. Each storage portion is optimally positioned, shaped and sized depending on the nature of the documents to be stored. It should be noted that in this embodiment, the term "document" may refer to a sheet of paper or to a stack of a plurality of sheets of paper. An example of a method of using the document file 1 during processing of a national application will be described below.

Figure 4:
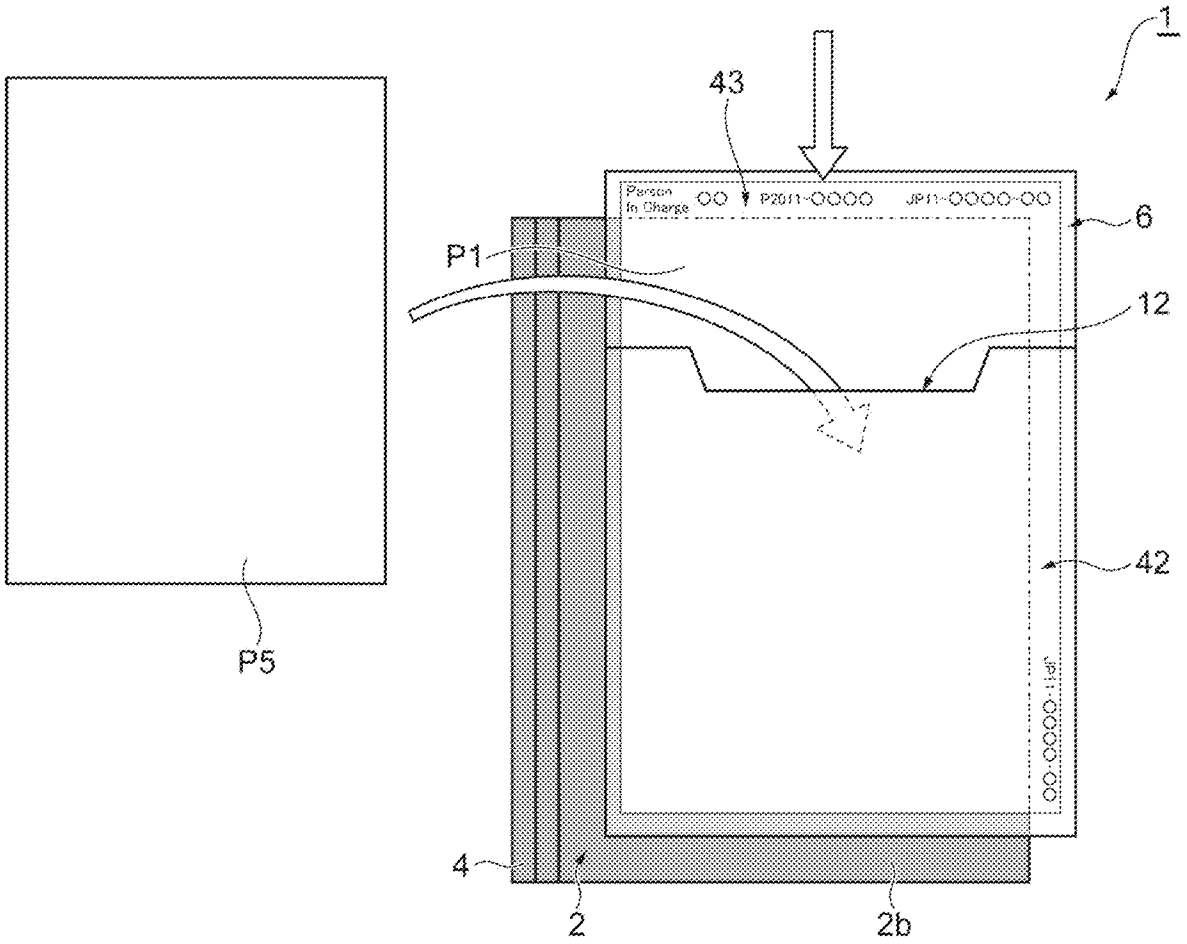
FIG. 4 is a diagram showing the document file in use.

A first document P1 that is classified into a first category is mainly a document which describes, for example, basic information and identification numbers of a case (see, FIG. 4). The first document P1 is stored in the clear file 6. The first document P1 describes, for example, title of the invention, name of client, information on person in charge of operations, identification numbers (e.g., application number, in-house case number, and client's case number), due date management information, status information, and information on basic priority application. Since the first document P1 becomes a part of the front side cover of the document file 1, the information mentioned above can be seen at a glance from outside without having to open the document file 1. The first document P1 is thus not meant to be turned over for checking the information and is preferably one sheet of paper of a standard size. Although the first document P1 may be a plurality of sheets of paper (i.e., a plurality of sheets of paper is to be inserted inside the clear file 6), the first document P1 is preferably stored in the clear file 6 such that at least the sheet of paper that describes important information including the basic information and identification numbers is disposed outermost to enable such information to be viewed from outside the document file 1. The identification numbers and information on the person in charge of operations are preferably indicated on side edges of the first document P1.

Figure 5:
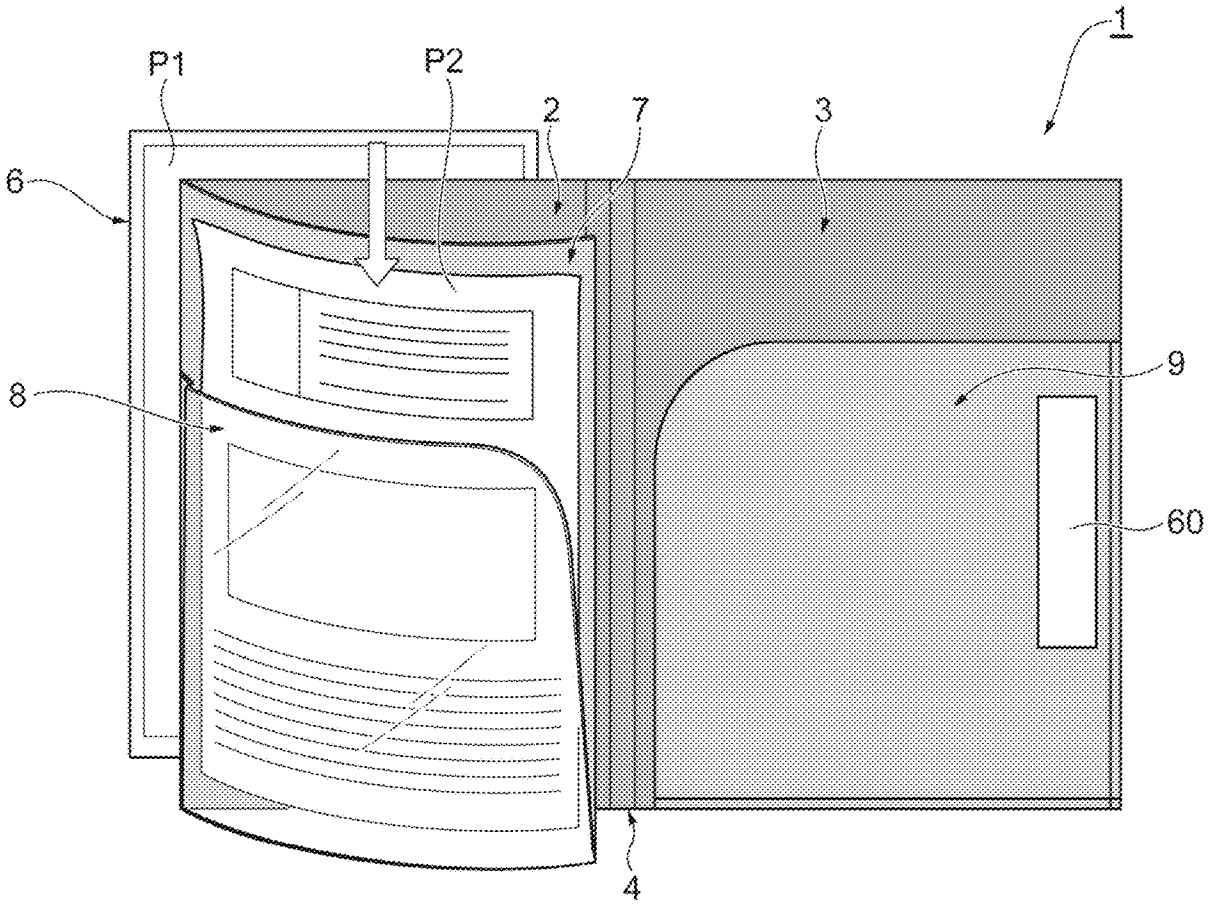
FIG. 5 is a diagram showing the document file in use.

A second document P2 that is classified into a second category mainly includes documents of communication within the office and documents on bibliographic data of the case (see, FIG. 5). The second document P2 is stored in the left side holder 8. Examples of documents of the second document P2 include instruction sheets for instructing sending of drafts or filing of applications, instruction sheets for invoices, bibliographic documents on the applicant, inventor, or the like, and documents on the basic prior application for claiming priority.

Figure 6:
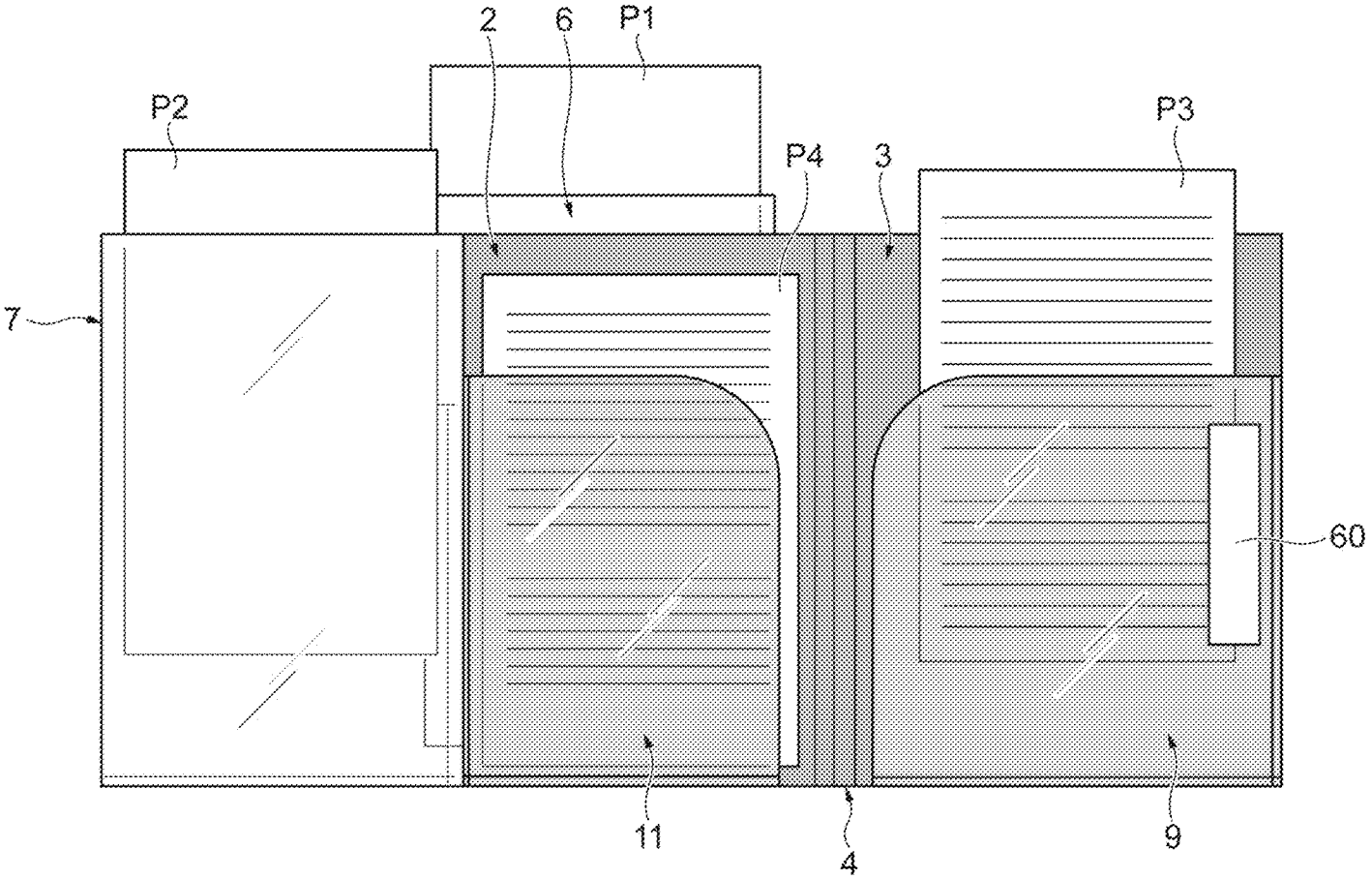
FIG. 6 is a diagram showing the document file in use.

A third document P3 that is classified into a third category mainly includes documents relating to communication between the office and the client (see, FIG. 6). The third document P3 is stored in the right side holder 9. Examples of documents of the third document P3 include invention disclosures or facsimiles from the client, and drafts and facsimiles sent to the client. The amount of the third document P3 tends to gradually increase compared to the second document P2 as communication with the client continues.

A fourth document P4 that is classified into a fourth category mainly includes documents such as technical material and drawings which are temporarily used by a patent engineer for writing the specification (see, FIG. 6). The fourth document P4 is stored in the auxiliary holder 11. There may be no fourth document P4 or there may only be a small amount thereof, or there may be a large amount thereof depending on the case and the person in charge.

A fifth document P5 that is classified into a fifth category mainly includes documents that are generated temporarily in the operation flow such as a person in charge appointment sheet (see, FIG. 4). The fifth document P5 is stored in the auxiliary pocket 12.

The front cover 2 functions as a base material for the front side of the document file 1 and is composed of a rectangular plate member. In this embodiment, the front cover 2 has a rectangular shape with a size that is set based on the A4 standard paper size. The front cover 2 includes a spine edge portion (first side edge portion) 21 that is joined to the spine portion 4, a fore edge portion (second side edge portion) 22 that is parallel and opposite to the spine edge portion 21, a top edge portion 23 that intersects the spine edge portion 21 and the fore edge portion 22 perpendicularly, and a tail edge portion 24 that intersects the spine edge portion 21 and the fore edge portion 22 perpendicularly and is parallel and opposite to the top edge portion 23. When the document file 1 is closed (the condition of FIG. 1), the front cover 2 has an inner surface 2*a* that is located inside the document file 1 and an outer surface 2*b* that is located outside the document file 1.

The rear cover 3 functions as a base material for a rear side of the document file 1 and is composed of a rectangular plate member. In this embodiment, the rear cover 3 has a rectangular shape with a size that is set based on the A4 standard paper size. The rear cover 3 includes a spine edge portion (first side edge portion) 31 that is joined to the spine portion 4, a fore edge portion (second side edge portion) 32 that is parallel and opposite to the spine edge portion 31, a top edge portion 33 that intersects the spine edge portion 31 and the fore edge portion 32 perpendicularly, and a tail edge portion 34 that intersects the spine edge portion 31 and the fore edge portion 32 perpendicularly and is parallel and opposite to the top edge portion 33. The long dimension of the rear cover 3 is the same as the long dimension of the front cover 2. The short dimension of the front cover 2 is shorter than the short dimension of the rear cover 3. When the document file 1 is closed (the condition of FIG. 1), the rear cover 3 includes an inner surface 3*a* that is located inside the document file 1 and an outer surface 3*b* that is located outside the document file 1.

The spine portion 4 connects the front cover 2 to the rear cover 3, functions as a base material of a spine side, and is composed of an elongated rectangular plate member. The spine portion 4 is foldably joined to the spine edge portion 21 of the front cover 2 via a fold line L1 and is foldably joined to the spine edge portion 31 of the rear cover 3 via a fold line L3. In the center of the short side of the spine portion 4, a fold line L2 is formed along the long side. The fold lines L1 to L3 are folded according to the amount of documents. For example, when there is only a small amount of documents, only the fold line L1 is folded as shown in FIG. 1. The spine portion 4 thus constitutes a plane continuous with the front cover 2. When there is a large amount of documents, the fold line L2 or the fold line L3 is folded in addition to the fold line L1.

The front cover 2, the spine portion 4, and the rear cover 3 are composed of a rectangular plate-shaped base plate BP. That is, the fold lines L1 to L3 are formed in the center portion of the base plate BP and by folding any one of the fold lines L1 to L3, the front cover 2, the spine portion 4, and the rear cover 3 are formed.

The clear file 6 is a flat pocket-shaped storage portion that is provided on the outer surface 2*b* of the front cover 2 for storing the first document P1. The clear file 6 has a rectangular shape with a size that is set based on the A4 standard paper size. The clear file 6 has the same rectangular shape as the front cover 2 when viewed from a thickness direction of the front cover 2. The clear file 6 is disposed offset toward the top edge portion 23 and the fore edge portion 22 in a planar direction from a position of the clear file 6 laid on top of the front cover 2 (such that the long sides and the short sides of the clear file 6 and the front cover 2 are aligned) covering the outer surface 2*b* of the entire area of the front cover 2 when viewed from the thickness direction.

With the formation of extending borders 42, 43 due to misalignment of the front cover 2 and the clear file 6, the spine edge portion 21 and the tail edge portion 24 of the front cover 2 become exposed without being covered by the clear file 6 by dimensions similar to the amount of extension of each of the extending borders 42, 43. The first document P1 is inserted into the clear file 6 so that the outer surface 2*b* of the front cover 2 is covered by the first document P1 and cannot be viewed, but the exposed spine edge portion 21 and tail edge portion 24 can be seen from the outside. It should be noted that although in this embodiment the size of the first document P1 to be stored in the clear file 6 is set to an A4 paper, which is the reference size that determines the dimension of the front cover 2, paper with sizes other than the reference size can be used as the paper to be inserted into the clear file 6. In that case, the size of the clear file 6 may be changed to match the paper being used.

The clear file 6 is configured to be capable of receiving one or a few sheets of A4 paper and not a stack of documents. Additionally, the clear file 6 is configured to be capable of securely holding the stored first document P1 so that the stored first document P1 does not fall out. Specifically, the clear file 6 has a flat pocket-shaped configuration in which rectangular inner and outer sheets of the same dimensions are placed on top of each other, with only the top part open.

The inner sheet of the clear file 6 and the outer surface 2*b* of the front cover 2 are fully or partially adhered (or partially welded) in the portion where the clear file 6 overlaps the front cover 2.

On the outer surface of the outer sheet of the clear file 6, the auxiliary pocket 12 for storing the fifth document P5 is provided. The auxiliary pocket 12 is configured by securing a rectangular sheet on the outer surface of the outer sheet of the clear file 6.

The sheet 7 is a sheet-like member that covers the inner surface 2*a* of the front cover 2. The sheet 7 has a rectangular shape with a size that is set based on the A4 standard paper size. The sheet 7 has the same rectangular shape as the front cover 2 when viewed from the thickness direction of the front cover 2. The sheet 7 is openably and closably joined to the fore edge portion 22 of the front cover 2, with a joining portion 51 with the fore edge portion 22 being a folding portion. The sheet 7 is joined to the fore edge portion 22 of the front cover 2, but not to the spine edge portion 21, the top edge portion 23, or the tail edge portion 24. This enables the sheet 7 to be moved from a position covering the inner surface 2*a* of the front cover 2 (see, FIG. 2) to an open position (see, FIG. 3), with the joining portion 51 with the front cover 2 being the folding portion. In the condition of FIG. 2, the surface of the sheet 7 that faces the inner surface 2*a* of the front cover 2 is a rear surface 7*b* of the sheet 7, and the surface thereof that is visible from outside is a front surface 7*a*. In this embodiment, the joining portion 51 of the sheet 7 is configured by folding a fore edge side of the sheet 7 over the fore edge portion 22 of the front cover 2 onto the outer surface 2*b* and securing the same to the fore edge portion 22 of the outer surface 2*b*.

The left side holder 8 functions to store the second document P2 and is provided on the front surface 7*a* of the sheet 7. That is, the left side holder 8 is provided on the front surface 7*a* which is a surface of the sheet 7, opposite the front cover 2 when the sheet 7 is in a configuration covering the inner surface 2*a* of the front cover 2. The left side holder 8 is configured by securing a holder member 53 to the front surface 7*a* of the sheet 7. The holder member 53 is a substantially rectangular sheet-like member that is arranged so as to cover a portion of the area of the bottom side of the sheet 7. The corner of the holder member 53 between the side edge of the top side and the side edge of the spine side is rounded. To increase storage capacity of the left side holder 8, gussets are preferably formed on the side edges of the bottom side and the fore edge side of the holder member 53. It should be noted that the method for securing the holder member 53 to the sheet 7 is not particularly limited and welding or adhesion may be employed.

The right side holder 9 functions to store the third document P3 and is provided on the inner surface 3*a* of the rear cover 3. The right side holder 9 is configured by securing a holder member 54 to the inner surface 3*a* of the rear cover 3. The holder member 54 is a substantially rectangular sheet-like member that is arranged so as to cover a portion of the area of the bottom side of the rear cover 3. The corner of the holder member 54 between the side edge of the top side and the side edge of the spine side is rounded. To increase storage capacity of the right side holder 9, gussets are preferably formed on the side edges of the bottom side and the fore edge side of the holder member 54. It should be noted that the method for securing the holder member 54 to the rear cover 3 is not particularly limited and welding or adhesion may be employed.

The auxiliary holder 11 functions to store the fourth document P4 and is provided on the inner surface 2*a* of the front cover 2. The auxiliary holder 11 is configured by securing a holder member 56 to the inner surface 2*a* of the front cover 2. The holder member 56 is a substantially rectangular sheet-like member that is arranged so as to cover a portion of the area of the bottom side of the front cover 2. The corner of the holder member 56 between the side edge of the top side and the side edge of the spine side is rounded. To increase storage capacity of the auxiliary holder 11, gussets are preferably formed on the side edges of the bottom side and the fore edge side of the holder member 56. It should be noted that the method for securing the holder member 56 to the front cover 2 is not particularly limited and welding or adhesion may be employed. Company credo, office slogans, and the like may be printed on the auxiliary holder 11, for example, in the area indicated at AE in FIG. 3.

Materials and the like of the members will now be described. A high strength hard material is used for the base plate BP that constitutes the front cover 2, the rear cover 3, and the spine portion 4. The material used for the base plate BP has a higher strength and is less susceptible to deformation than, at least, the material used for the clear file 6, the sheet 7, the auxiliary pocket 12, and the holder members 53, 54, 56. The specific material of the base plate BP is not particularly limited and need only be strong enough to ensure that when the document file 1 is placed on a shelf (whether in a vertical or horizontal orientation), the entire document file 1 can maintain its position without deforming, and when the document file 1 is bound, for example, with a rubber band, the entire document file 1 does not deform and roll up. For example, a plastic material (e.g., a PP material) or cardboard having a thickness of about 0.4 to 1 mm can be used for the material of the base plate BP. The materials of the clear file 6, the sheet 7, the auxiliary pocket 12, and the holder members 53, 54, 56 are also not particularly limited, and need only be strong enough to be able to store and hold documents. For example, a thin film-like plastic material (e.g., a PP material of about 0.2 mm) may be used. For these materials, using a material that permits a certain degree of deformation, unlike for the base plate BP, makes it possible to easily cater for situations where the number of documents to be stored has increased. Although the colors of the materials are not particularly limited, the base plate BP is preferably colored depending on the operation and not transparent (or opaque). On the other hand, the clear file 6, the sheet 7, the auxiliary pocket 12, and the holder members 53, 54, 56 are preferably transparent (or opaque) so that their contents can be viewed from outside. It should be noted that they may be colored with the same color as the base plate BP as long as a transparent material is used.

As shown in FIGS. 2 and 3, the document file 1 according to the embodiment is provided with a spacer 60 on the right side holder 9. This spacer 60 has a hook and loop fastener that includes a hook portion 62 and a loop portion 64.

The spacer 60 is elongated and is arranged such that a longitudinal direction thereof extends along the fore edge portion 32 of the rear cover 3. Either the hook portion 62 or the loop portion 64 is secured to the right side holder 9. Here, the hook portion 62 is secured to the right side holder 9. The loop portion 64 is removably connected to the hook portion 62.

The method for securing the hook portion 62 to the right side holder 9 is not particularly limited, and the hook portion 62 may be secured, for example, with an adhesive tape. Securing the hook portion 62 with an adhesive tape enables the spacer 60 to be attached also to existing document files. The loop portion 64 can be flexible and may be, for example, a soft fabric or a synthetic fiber fabric on which loops are formed.

Although the case in which the hook portion 62 is secured to the right side holder 9 is described above, the loop portion 64 may be secured to the right side holder 9. In this case, the hook portion 62 may be flexible.

A method for adjusting a thickness of the document file 1 according to an embodiment of the present invention will now be described.

Figure 7:
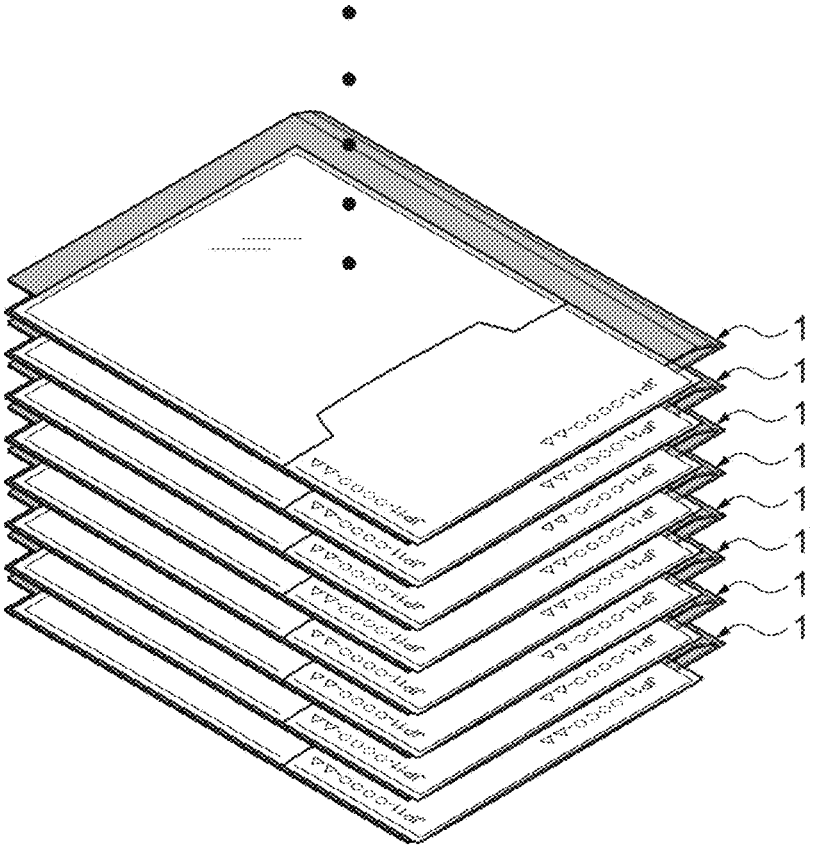
FIG. 7 is a perspective view showing a plurality of the document files piled flat.
Figure 8:
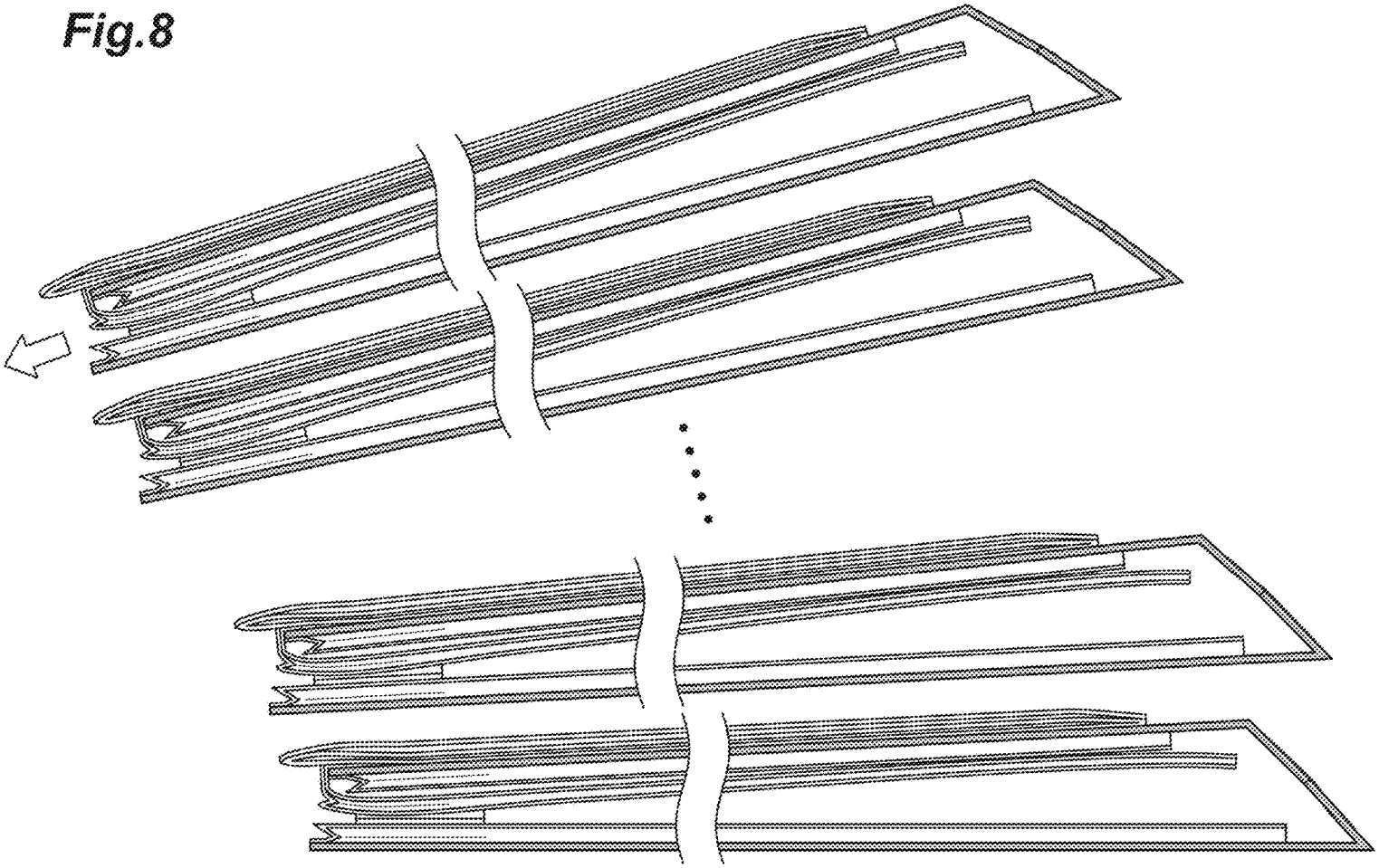
FIG. 8 is a diagram showing a plurality of document files without spacers piled flat.

As shown in FIG. 7, a plurality of the document files 1 are often stored laid flat on a desk on top of each other in the same direction. As shown in FIG. 8, in the case of document files that are not provided with the spacer 60, as the number of the stacked document files increases, thicknesses of the spine portions of the document files become stacked, causing the height on the side of the spine portions to be higher than that on the opposite side so that a tilt is created. As a result, the document files on the top may slide off.

Figure 9:
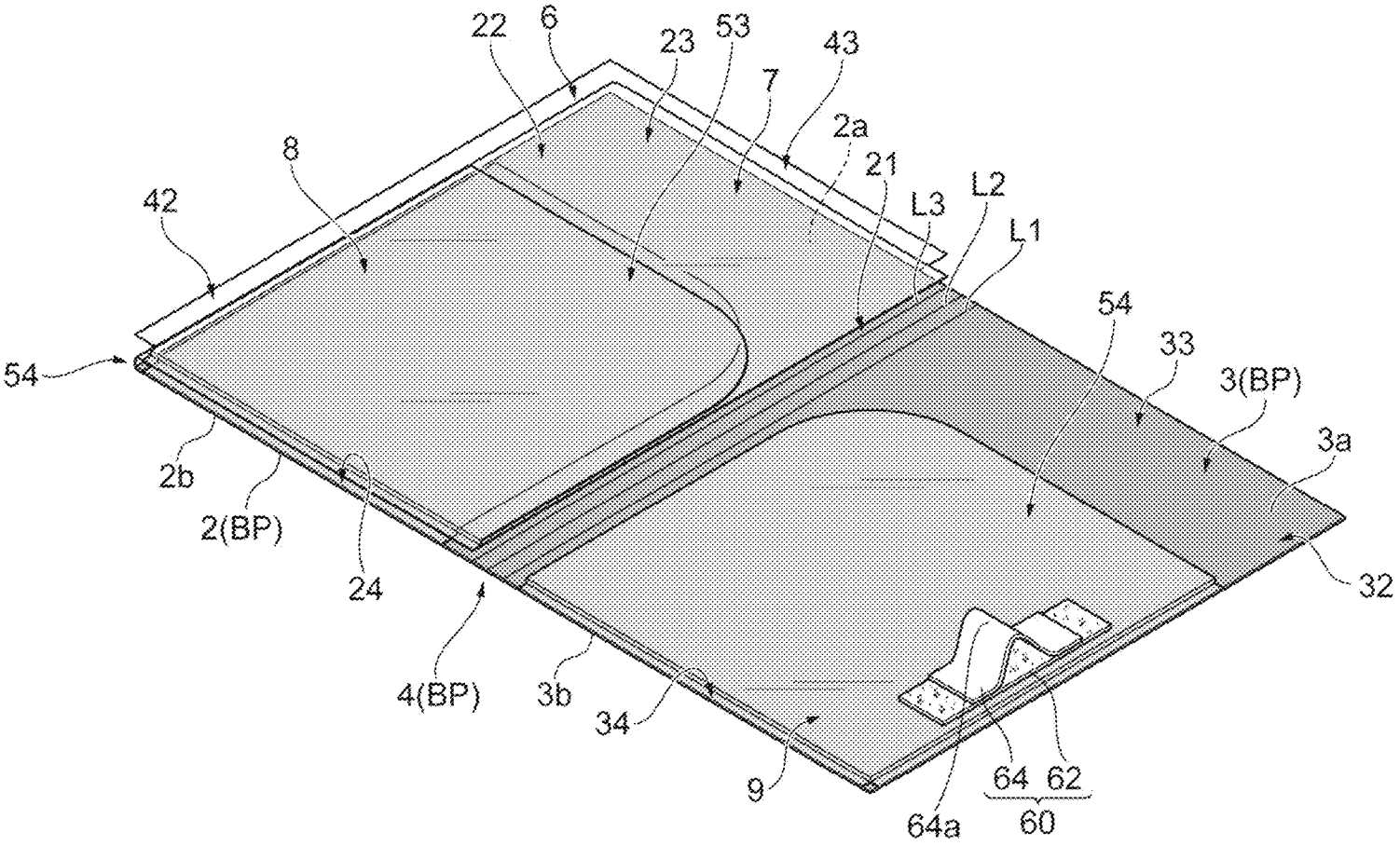
FIG. 9 is a perspective view showing a spacer provided on the document file with a height of the spacer adjusted.

However, as shown in FIG. 9, in the document file 1 according to this embodiment, a height of the spacer 60 can be adjusted according to a space between the fore edge portion 22 of the front cover 2 and the fore edge portion 32 of the rear cover 3. That is, if the space between the fore edge portion 22 of the front cover 2 and the fore edge portion 32 of the rear cover 3 is large when measured, the loop portion 64 can be connected to the hook portion 62 with increased deflection to form a large convex portion 64*a*. If the space is small, the loop portion 64 can be connected to the hook portion 62 with reduced deflection to form a small convex portion 64*a*. It should be noted that the measurement of the space is not limited to precise measurement using a tape measure, but also includes rough visual measurement.

Figure 10:
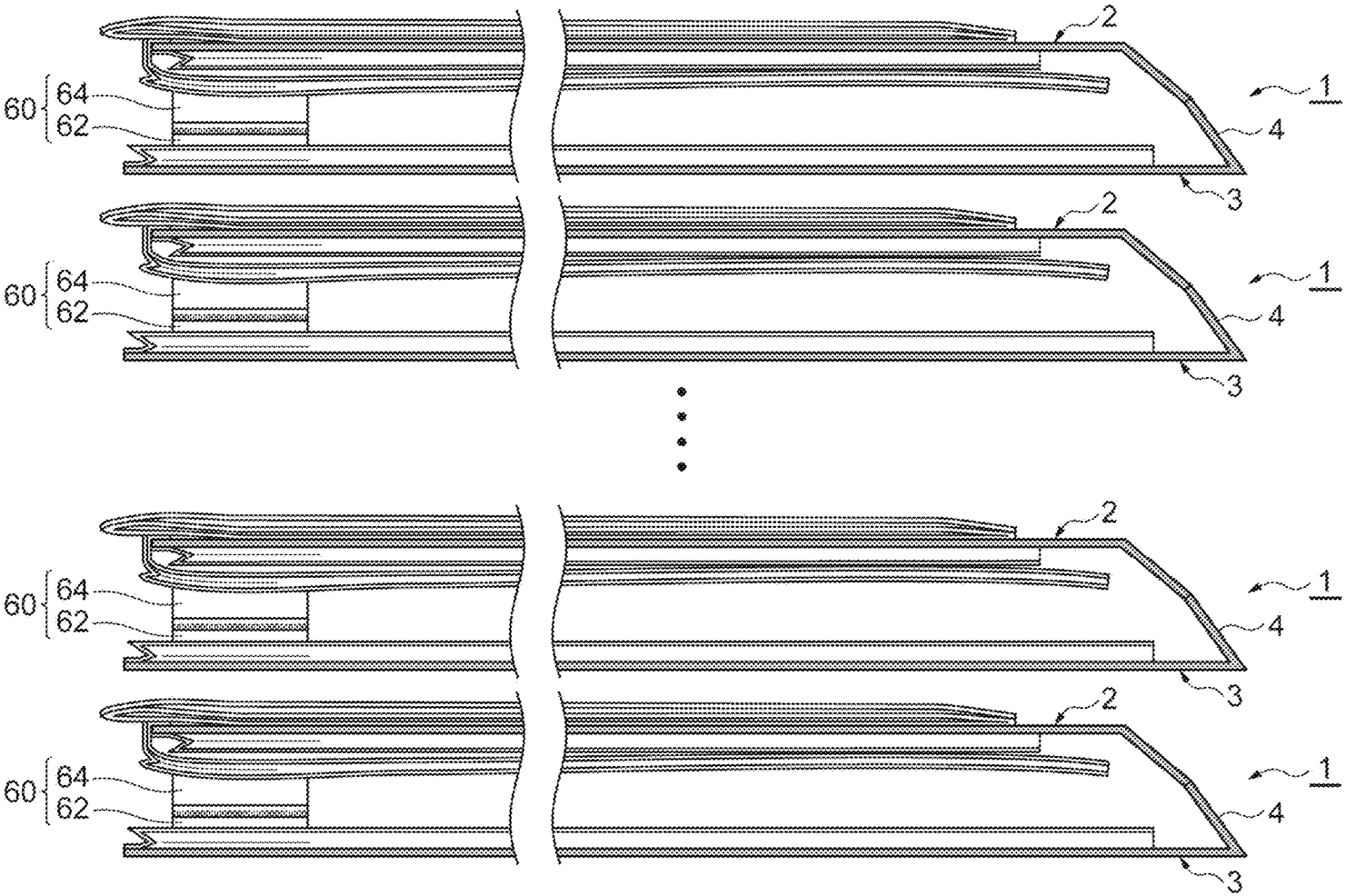
FIG. 10 is a diagram showing a plurality of the document files with the spacers piled flat.
Figure 11:
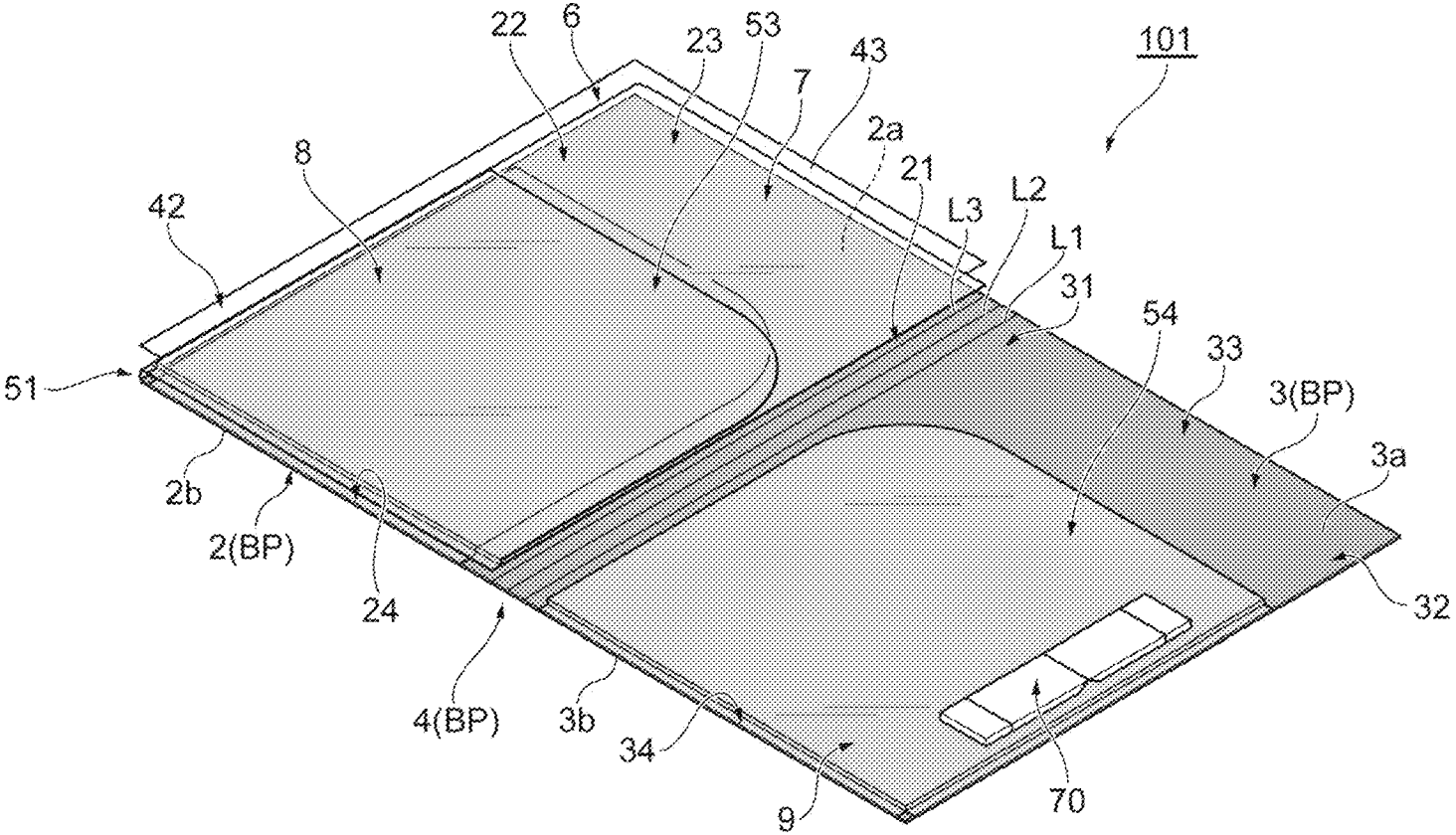
FIG. 11 is a perspective view showing a document file of another example open.

The convex portion 64*a* formed in this manner receives the left side holder 8 on the inner surface 2*a* of the front cover 2 and fills the space. Thus, as shown in FIG. 10, a smaller or zero difference is achieved between the thickness on the side of the spine portion 4 of the document file 1 and the thickness on the side of the fore edge portions 22, 32 thereof. As a result, the document files 1 can be piled up with each document file 1 remaining substantially horizontal even when the number of the stacked document files 1 increases, so that the tilt is suppressed preventing the document files 1 from sliding off.

With reference to FIGS. 11 to 14, a document file 101 according to another embodiment will now be described. Elements that are the same as those of the above document file 1 are given the same numerals and redundant description thereof will be omitted.

In this document file 101, the configuration of a spacer 70 is different from that of the spacer 60 of the above document file 1. The spacer 70 has a spacer body 72 and a plurality of projections 74.

Figure 12:
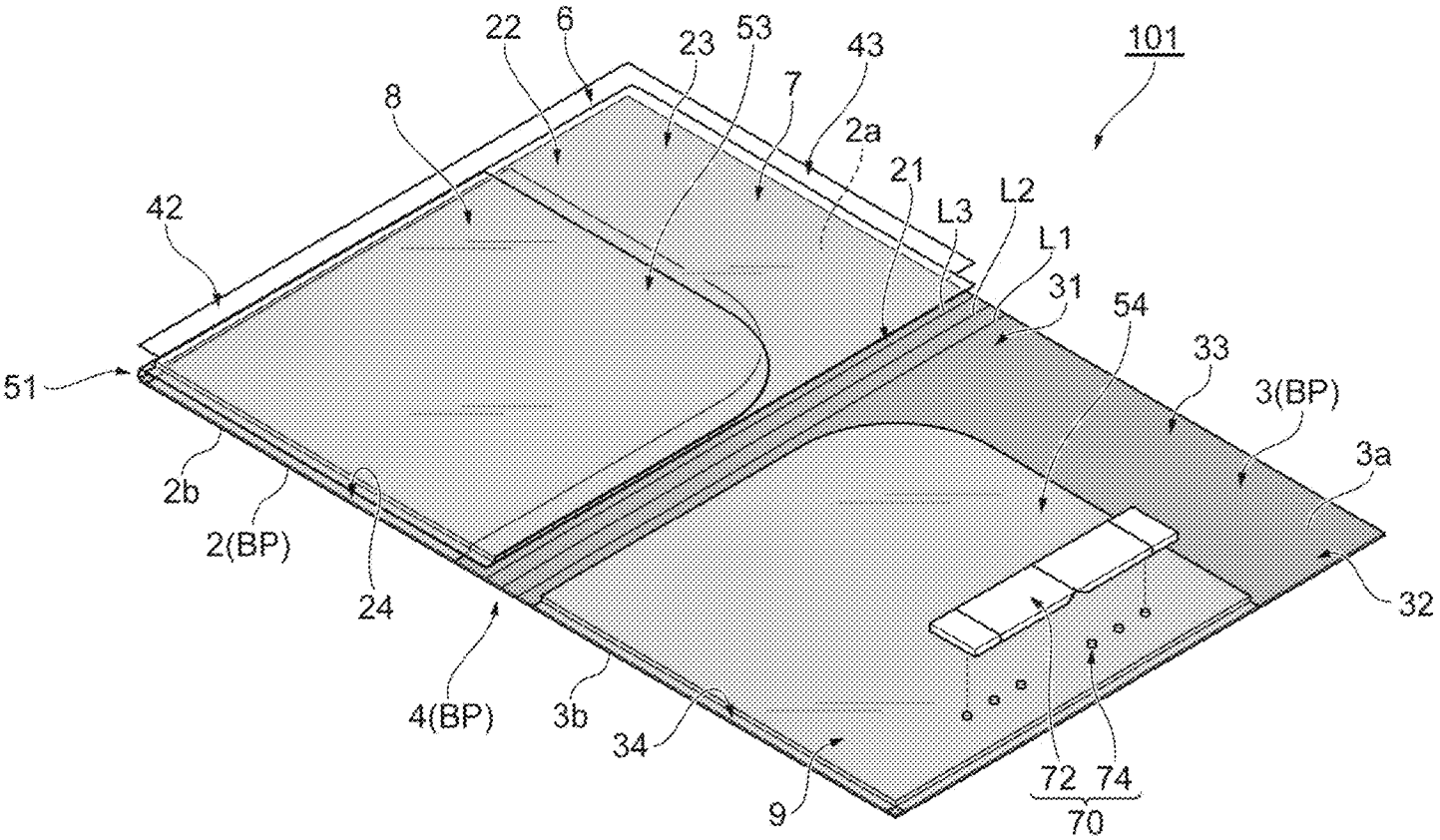
FIG. 12 is an exploded perspective view showing the spacer of the document file of another example.

As shown in FIG. 12, the plurality of projections 74 are provided spaced apart on the right side holder 9 along the fore edge portion 32 of the rear cover 3. In FIG. 12, three pairs of the projections 74 are provided. It should be noted that the number of the projections 74 is not limited to three pairs. The greater the number of the projections 74, the greater the degree of freedom for height adjustment of the spacer 70. Although the projections 74 may be provided directly on the right side holder 9, a base may be prepared on which the projections 74 are provided with an adhesive portion on the other side of the base. Securing the base on which the plurality of projections 74 are provided to the right side holder 9 via the adhesive portion enables the spacer 70 to be attached also to existing document files.

The spacer body 72 has a first attachment portion 72*a* that is removably fitted to one of the projections 74, a second attachment portion 72*b* that is removably fitted to another one of the projections 74, a first plate piece 72*c* that is bendably connected to the first attachment portion 72*a*, and a second plate piece 72*d* that is bendably connected to the second attachment portion 72*b*.

Figure 13:
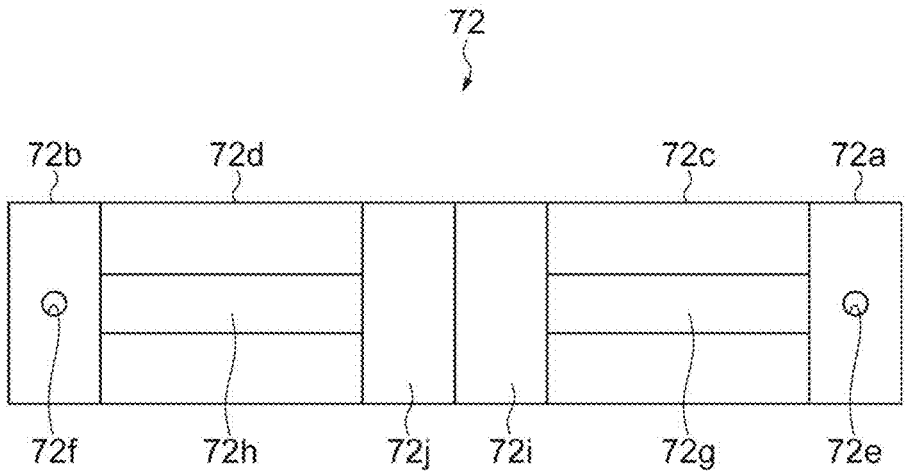
FIG. 13 is a bottom view of a spacer body.

As shown in FIG. 13, recesses 72*e*, 72*f* are provided on the backs of the first and second attachment portions 72*a*, 72*b*, into which the projections 74 fit. On the backs of the first and second plate pieces 72*c*, 72*d*, grooves 72*g*, 72*h* are provided to avoid interference with the projections 74. The fittings between the projections 74 and the recesses 72*e*, 72*f* preferably also have a retaining function such as in a snap button.

The first plate piece 72*c* is bendably connected to the second plate piece 72*d*, and on the backs of the first and second plate pieces 72*c*, 72*d*, notches 72*i*, 72*j* are provided to avoid interference between the first and second plate pieces 72*c*, 72*d* when the first and second plate pieces 72*c*, 72*d* are bent to form a convex portion 76.

A method for adjusting a thickness of the document file 101 will now be described.

Figure 14:
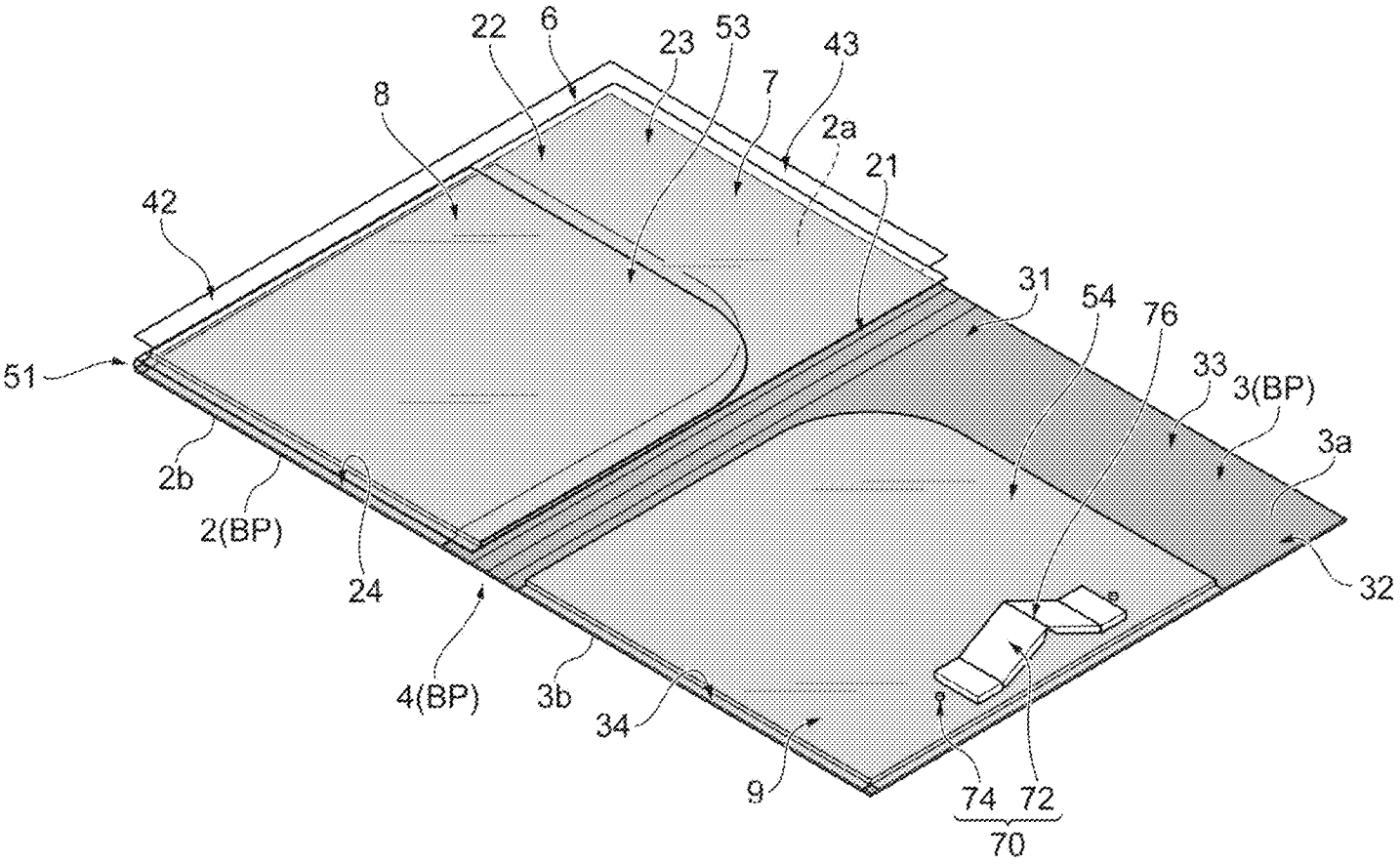
FIG. 14 is a perspective view showing the spacer provided on the document file of another example with the height of the spacer adjusted.

Also in the document file 101 according to this embodiment, as shown in FIG. 14, the height of the spacer 70 can be adjusted according to the space between the fore edge portion 22 of the front cover 2 and the fore edge portion 32 of the rear cover 3. That is, if the space between the fore edge portion 22 of the front cover 2 and the fore edge portion 32 of the rear cover 3 is large when measured, slope of the first plate piece 72*c* and the second plate piece 72*d* of the spacer body 72 can be increased to form a large convex portion 76. If the space is small, the slope of the first plate piece 72*c* and the second plate piece 72*d* can be decreased to form a small convex portion 76.

The convex portion 76 formed in this manner receives the left side holder 8 on the inner surface 2*a* of the front cover 2 and fills the space. Thus, similar to that shown in FIG. 10, a smaller or zero difference is achieved between the thickness on the side of the spine portion 4 of the document file 101 and the thickness on the side of the fore edge portions 22, 32 thereof. As a result, the document files 101 can be piled up with each document file 101 remaining substantially horizontal even when the number of the stacked document files 101 increases, so that the tilt is suppressed preventing the document files 101 from sliding off.

The present invention is not limited to the above embodiments.

Figure 15:
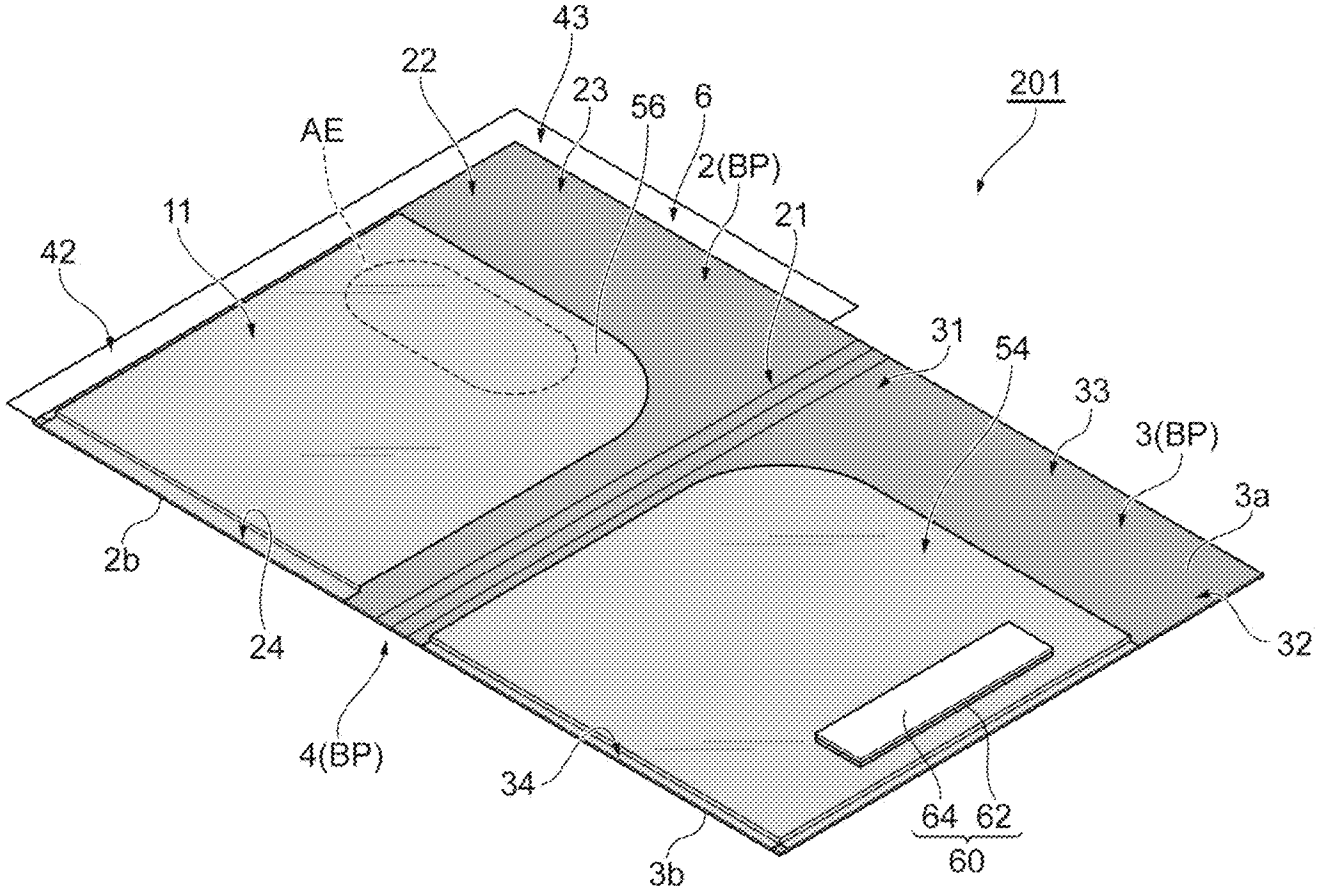
FIG. 15 is a perspective view showing the document file of yet another example open.

Although in the above document files 1, 101, the sheet 7 (and the left side holder 8 that is provided thereon) is openably and closably provided on the front cover 2, the sheet 7 and the left side holder 8 may be omitted to configure a document file 201, as shown in FIG. 15.

Although for the above document files 1, 101, 201, a document file with a size that is set based on the A4 standard paper size is described, the basic standard size is not particularly limited and other standard sizes including A5, B5, and B4 may be employed.

Although in the above document files 1, 101, the spacers 60, 70 are provided on the right side holder 9, the spacers 60, 70 may be provided on the left side holder 8. Alternatively, the spacers 60, 70 may be provided on both the right side holder 9 and the left side holder 8.

Although in the above document file 201, the spacers 60, 70 are provided on the right side holder 9, the spacers 60, 70 may be provided on the auxiliary holder 11. Alternatively, the spacers 60, 70 may be provided on both the right side holder 9 and the auxiliary holder 11.

What is claimed is:

1. A document file for storing documents, comprising:

a rectangular front cover having opposing first and second side edge portions;

a rectangular rear cover having opposing first and second side edge portions;

a spine portion connecting the first side edge portion of the front cover to the first side edge portion of the rear cover;

a first storage portion provided on an inner surface of the front cover for storing documents;

a second storage portion provided on an inner surface of the rear cover for storing documents;

a sheet bendably connected to the second side edge portion of the front cover and movable between a closed position covering the inner surface of the front cover and an open position spaced apart from the inner surface of the front cover;

a third storage portion provided on a surface of the sheet, opposite the front cover when the sheet is in a configuration wherein the sheet covers the inner surface of the front cover; and a spacer provided on at least one of the second storage portion and the third storage portion for adjusting a space between the second side edge portion of the front cover and the second side edge portion of the rear cover, wherein the spacer includes:

a plurality of projections spaced apart on the document file;

a first attachment portion to be removably fitted to one of the plurality of projections;

a second attachment portion to be removably fitted to another one of the plurality of projections;

a first plate piece bendably connected to the first attachment portion; and a second plate piece bendably connected to the second attachment portion, the first plate piece being bendably connected to the second plate piece.

2. A document file for storing documents, comprising:

a rectangular front cover having opposing first and second side edge portions;

a rectangular rear cover having opposing first and second side edge portions;

a spine portion connecting the first side edge portion of the front cover to the first side edge portion of the rear cover;

a first storage portion provided on an inner surface of the front cover for storing documents;

a second storage portion provided on an inner surface of the rear cover for storing documents; and a spacer provided on at least one of the second storage portion and the third storage portion for adjusting a space between the second side edge portion of the front cover and the second side edge portion of the rear cover, wherein the spacer includes:

a plurality of projections spaced apart on the document file;

a first attachment portion to be removably fitted to one of the plurality of projections;

a second attachment portion to be removably fitted to another one of the plurality of projections;

a first plate piece bendably connected to the first attachment portion; and a second plate piece bendably connected to the second attachment portion, the first plate piece being bendably connected to the second plate piece.

* * * * *